US008997275B2

(12) United States Patent
Higgs et al.

(10) Patent No.: US 8,997,275 B2
(45) Date of Patent: Apr. 7, 2015

(54) ARTICLE OF FURNITURE HAVING IN-BUILT STORAGE FACILITIES

(75) Inventors: Steven Leonard Higgs, New South Wales (AU); David Russell King, New South Wales (AU)

(73) Assignee: King Furniture Pty Ltd (AU)

( * ) Notice: Subject to any disclaimer, the term of this patent is extended or adjusted under 35 U.S.C. 154(b) by 1002 days.

(21) Appl. No.: 12/626,345

(22) Filed: Nov. 25, 2009

(65) Prior Publication Data

US 2010/0146703 A1 Jun. 17, 2010

(30) Foreign Application Priority Data

Nov. 27, 2008 (AU) ..... 2008906158

(51) Int. Cl.

| | |
|---|---|
| ***A47C 17/00*** | (2006.01) |
| ***A47C 16/02*** | (2006.01) |
| ***A47C 7/62*** | (2006.01) |
| ***A47C 17/86*** | (2006.01) |

(52) U.S. Cl.

CPC . *A47C 16/02* (2013.01); *A47C 7/62* (2013.01); *A47C 17/86* (2013.01)

(58) Field of Classification Search

USPC ..... D6/335, 371, 334, 364, 349, 484; 5/58, 5/944, 507.1, 503.1; 297/232, 445.1, 297/188.09, 188.1, 423.39; 312/235.1, 312/235.2, 235.3, 235.4; 206/745, 747, 749

See application file for complete search history.

(56) References Cited

U.S. PATENT DOCUMENTS

| | | | | | |
|---|---|---|---|---|---|
| 2,564,338 | A | * | 8/1951 | McCarroll | 108/62 |
| D224,857 | S | * | 10/1972 | Mazure | D6/334 |
| D231,886 | S | * | 6/1974 | Kephart | D6/484 |
| D231,887 | S | * | 6/1974 | Kephart | D6/484 |
| D238,133 | S | * | 12/1975 | Uebele | D6/455 |
| 4,663,516 | A | * | 5/1987 | Blum | 219/217 |
| 5,020,173 | A | * | 6/1991 | Dreyer, Jr. | 5/308 |
| 5,538,320 | A | * | 7/1996 | Hoffman et al. | 297/188.1 |
| 5,685,467 | A | * | 11/1997 | Niemi et al. | 224/404 |
| 5,758,372 | A | * | 6/1998 | Lopez Diaz | 5/200.1 |
| 6,854,803 | B2 | * | 2/2005 | Tomas et al. | 297/423.41 |
| 8,740,300 | B2 | * | 6/2014 | Daniels, Jr. | 297/188.09 |
| 2005/0081293 | A1 | * | 4/2005 | Connell et al. | 5/308 |

* cited by examiner

*Primary Examiner* — Peter M Cuomo
*Assistant Examiner* — Myles Throop
(74) *Attorney, Agent, or Firm* — Greenberg Traurig, LLP

(57) ABSTRACT

An article of furniture 10 comprises a box frame 12 defining a void 14 and having a first opening 18 and an opposed, second opening 20. A lid arrangement 22 is associated with the first opening 18 of the frame 12 for closing the first opening 18. The article of furniture 10 includes a tub member 24 for closing the second opening 20. The tub member 24 comprises a dished portion 28. The tub member 24 is reversibly connectable to the box frame 12 so that, in a first orientation, at least the dished portion 28 is received within the void 14 of the box frame 12 to form an assembly of reduced volume for transportation or storage purposes and, in a reversed, second orientation, the dished portion 28 of the tub member 24 extends away from the void 14 to form an assembly of increased volume defined by a combination of the void 14 defined by the frame 12 and the dished portion 28 of the tub member 24 in its second orientation.

13 Claims, 2 Drawing Sheets

ARTICLE OF FURNITURE HAVING IN-BUILT STORAGE FACILITIES

RELATED APPLICATION

The present application claims priority from Australian Provisional Patent Application No. 20089906158 filed on Nov. 27, 2008, the contents of which are incorporated herein by reference.

BACKGROUND

1. Field

The present invention relates, generally, to furniture and, more particularly, to an article of furniture particularly suitable for use in locations where space is at a premium.

The invention has been developed for use in chairs, sofas, ottomans, or the like and will be described hereinafter with reference to those applications. However, it will be appreciated that the invention is not limited to those particular applications and could be used in other applications, for example, beds.

2. General Background

Modern living often means that people in small apartments or houses have a need for extra storage. To accommodate this need, some sofas and beds with in-built storage have been proposed. However, such sofas and beds are often bulky and are aesthetically unappealing.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

In a first aspect, there is provided an article of furniture comprising:

a box frame defining a void and having a first opening and an opposed, second opening;

a lid arrangement associated with the first opening of the frame for closing the first opening; and a tub member for closing the second opening, the tub member comprising a dished portion and the tub member being reversibly connectable to the box frame so that, in a first orientation, at least the dished portion is received within the void of the box frame to form an assembly of reduced volume for transportation or storage purposes and, in a reversed, second orientation, the dished portion of the tub member extends away from the void to form an assembly of increased volume defined by a combination of the void defined by the frame and the dished portion of the tub member in its second orientation.

The article of furniture may include a set of legs or feet. The feet may secure the tub member removably to the frame, at least when the tub member is in its second orientation.

The tub member may be attached to the box frame so that a periphery of at least the dished portion of the tub member is recessed with respect to the outer periphery of the box frame, an outwardly extending flange being arranged about a mouth of the tub member.

By having the dished portion of the tub member recessed with respect to the outer periphery of the box frame, the visibility of the tub member is reduced, in use. To further reduce the visibility of the tub member, a peripheral wall of the dished portion may taper inwardly from the flange to a floor of the tub member.

Each foot may include a connector pin which is received in a corresponding socket defined in an operatively underside of the frame, each connector pin being received through an associated opening defined in the flange of the tub member, each opening, in use, being in register with one of the sockets of the frame. The pin may be a press-fit in its associated socket, passing through one of the openings in the flange of the tub member to secure the tub member to the frame.

In some embodiments, particularly for elongate articles of furniture, additional connectors may be provided for removably connecting the tub member to the frame.

The tub member may be of a dark color further to reduce the visibility of the tub member.

The tub member may be of a recyclable material. More particularly, the tub member may be of a suitable thermo-molded impact resistant plastics material. In a preferred form, the plastics material may be ABS, polypropylene, or the like.

The lid arrangement may comprise an upholstered box spring lid which is preferably hingedly connected to the frame. At least one fluid operable hinge assembly may hingedly connect the lid to the frame to assist in opening/closing the lid. The fluid operable hinge assembly may comprise a pivot-and-slide hinge mechanism and a fluid operable strut hingedly connecting the lid to the frame. Preferably, the article of furniture includes at least two, opposed hinge assemblies.

In a second aspect, there is provided an article of furniture comprising:

a box frame defining a void and having a first opening and an opposed, second opening, the box frame further having an outer periphery;

a lid arrangement associated with the first opening of the frame for closing the first opening; and a tub member for closing the second opening, the tub member comprising a dished portion and the tub member being attached to the box frame so that a periphery of at least the dished portion of the tub member is recessed with respect to the outer periphery of the box frame.

DRAWINGS

An embodiment will now be described, by way of example only, with reference to the accompanying drawings, in which.

DETAILED DESCRIPTION OF THE PREFERRED EMBODIMENT

Figure 6:
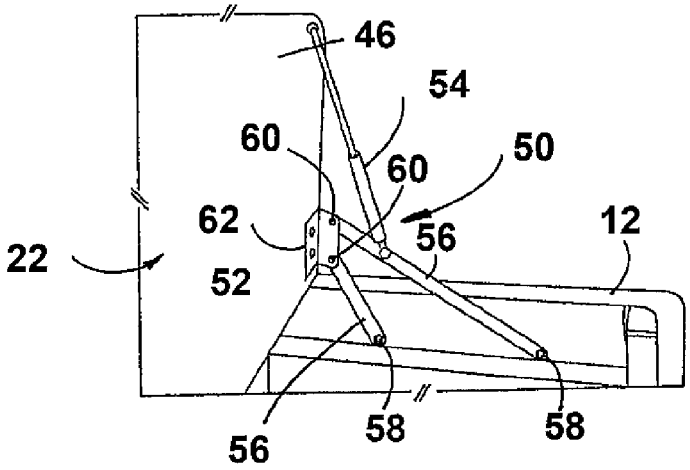
FIG. 6 is a three dimensional representation of a part of the article of furniture illustrating a hinge assembly of the article of furniture.
Figure 7:
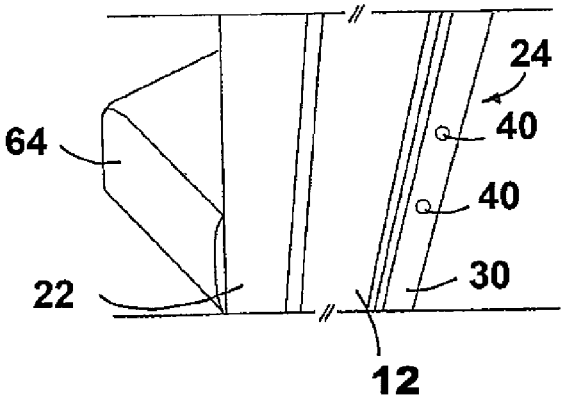
FIG. 7 is a three dimensional, underside view of a part of the article of furniture.
Figure 8:
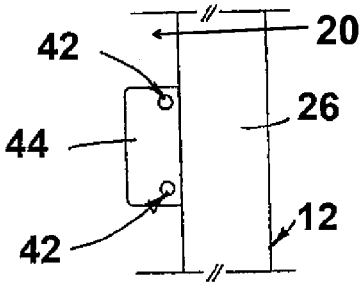
FIG. 8 is a bottom view of a part of the article of furniture with the tub member removed.

In the drawings, reference numeral 10 generally designates an article of furniture which, in the example illustrated in FIGS. 1-5, is in the form of an ottoman and in the example illustrated in FIGS. 6-8 is in the form of a sofa. The article of furniture 10 comprises a box frame 12 defining a void 14 and having an outer periphery 16. Further, the box frame 12 defines a first, operatively upper opening 18 (FIG. 2) and a second, operatively lower opening 20, a part of which is shown in FIG. 8 of the drawings.

A lid arrangement, or lid, 22 is associated with the first opening 18 for opening and closing the first opening 18 of the box frame 12.

The article of furniture 10 further includes a tub member, or tub, 24 which is attachable to an underside 26 (FIGS. 3 and 4) of the box frame 12 for closing off the second opening 20.

Figure 4:
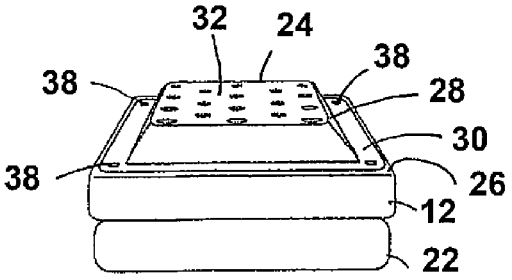
FIG. 4 is an underside perspective view of the article of furniture of FIG. 1, shown with the tub member in a second orientation.
Figure 5:
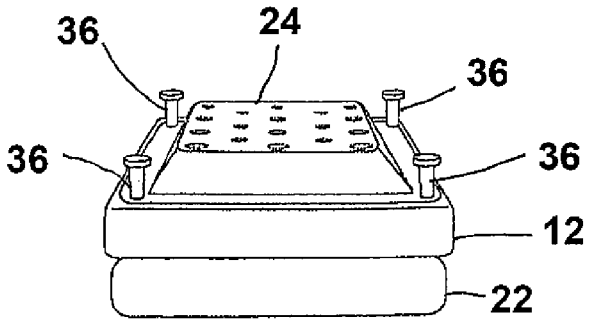
FIG. 5 is an underside perspective view of the article of furniture of FIG. 1, shown with the tub member in its second orientation and retained in position by feet of the article of furniture.

As illustrated most clearly in FIG. 4 of the drawings, the tub 24 has a dished portion 28 surrounded by an outwardly extending flange 30. The dished portion 28 tapers inwardly from the flange 30 to a bottom or floor 32 of the tub 24.

Figure 1:
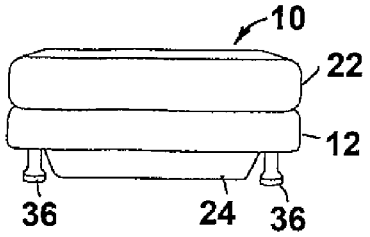
FIG. 1 is a front perspective view of an embodiment of an article of furniture, in accordance with the present disclosure, shown with a lid of the article of furniture closed.
Figure 2:
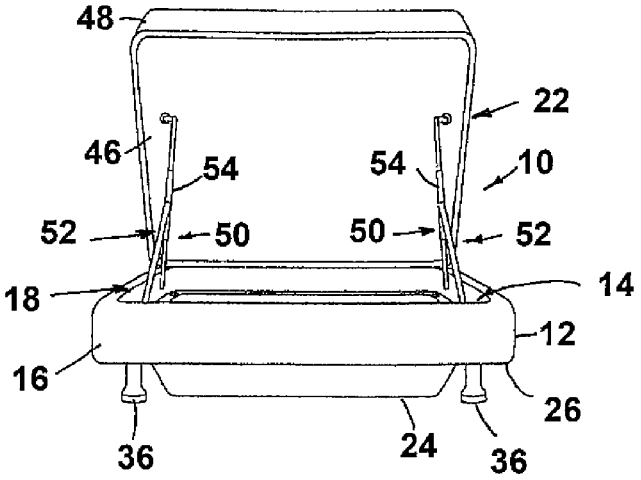
FIG. 2 is a front perspective view of the article of furniture of FIG. 1, shown with the lid open.
Figure 3:
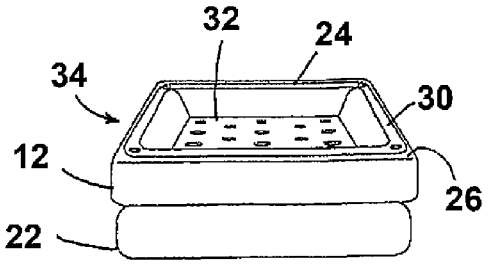
FIG. 3 is an underside perspective view of the article of furniture of FIG. 1, shown with a tub member of the article of furniture in a first orientation.

The frame 12 and the tub 24, together, define an assembly 34. The tub 24 is reversibly attachable to the underside 26 of the box frame 12. In a first orientation, the tub 24 is mounted to the underside 26 of the box frame 12 so that the dished portion 28 of the tub 24 is received in the void 14 of the box frame 12 for storage and/or transportation purposes. Such an orientation is shown in FIG. 3 of the drawings. For use, the tub 24 is reversed so that the dished portion 28 extends outwardly from the underside 26 of the frame 12 to form an increased volume for storage of goods as shown in FIG. 4 of the drawings.

In an embodiment, the article of furniture 10 includes a plurality of legs or feet 36. An operatively upper end of each foot 36 carries a longitudinally extending pin connector (not shown). Each connector is received through an opening 38 defined in the flange 30 of the tub 24 for retaining the tub 24 at least in its second orientation relative to the frame 12. The pin connector is received through the flange 30 of the tub 24 to be a press-fit in a socket defined in the underside 26 of the frame 12 for retaining the tub 24 at least in its second orientation relative to the frame 12. It will be appreciated that, instead of being a press-fit, the connector could be threaded to screw-threadedly engage a threaded socket defined in the underside 26 of the frame 12.

For longer articles of furniture, for example, sofas or sofa extensions, additional connectors may be provided. These connectors are shown as pins 40 in FIG. 7 of the drawings. The connector pins 40 are received in openings 42 defined in a bracket 44. The bracket 44 is attached to an inner surface of the box frame 12 in alignment with the underside 26 of the frame 12. Once again, each pin 40 is a press-fit within its associated opening 42.

The tub 24 is, preferably, of a recyclable material. A preferred material is an impact resistant, thermo-molded plastics material such as ABS or polypropylene. Further, the tub 24 is of a dark color, such as black, so that, when mounted in its second orientation, the tub 24 is not readily visible. To further improve the aesthetic appearance of the article of furniture 10, the sidewalls 28 of the tub 24 are recessed with respect to the outer periphery 16 of the frame 12. By recessing the tub 24 with respect to the frame 12 and having the tub 24 of a dark color, the visibility of the tub 24 is reduced and the appearance of the article of furniture 10 is enhanced.

It will also be appreciated that, when the storage volume defined by the assembly comprising the frame 12 and the tub 24 mounted on the frame 12 in it is second orientation is not required, the tub 24 can be reversed to its first orientation (FIG. 3) to improve the aesthetic appearance of the article of furniture 10 and also to facilitate cleaning under the article of furniture 10.

The lid 22 is, preferably, hingedly attached to the frame 12. The lid 22 has a base member 46 and a cushioned, box spring structure 48 mounted on the base member 46.

The lid 22 is hingedly attached to the frame 12 by means of a pair of opposed hinge assemblies 50. Each hinge assembly 50 comprises a pivot-and-slide hinge mechanism 52 and a fluid operable strut 54 as shown most clearly in FIG. 6 of the drawings. The fluid operable strut 54 is, preferably, a pneumatic strut and facilitates raising of the lid 22 relative to the frame 12. It will be appreciated that extension of the pneumatic struts 54 of the hinge assembly 52 counteracts the weight of the lid 22 thereby making it easier to raise the lid 22 relative to the frame 12.

The pivot-and slide-mechanism 52 of each hinge assembly 50 comprises a pair of arms 56. A first end of each arm 56 is hingedly attached, as at 58, to an inner surface of the frame 12. An opposed end of each arm 56 is pivotally attached, as at 60, to a bracket 62 mounted to the underside of the base member 46 of the lid 22. With this arrangement, as the lid 22 is raised, an operatively rear edge 62 of the lid can slide clear of a backrest 64 (FIG. 7) of an article of furniture 10 having such a backrest 64.

It is an advantage of the use of the tub 24 that it facilitates neat and convenient storage by extending the void in the frame 12 when the tub 24 is in its second orientation. The recessing of the sidewall 28 of the tub 24 relative to the periphery 16 of the frame 12 further enhances the appearance of the article of furniture 10. This is accentuated by the dark coloring of the tub 24 which reduces the visual impact of the tub 24.

In addition, the reversibility of the tub 24 relative to the frame 12 reduces the volume of the article of furniture 10 for storage and/or transportation purposes. As described above, the tub 24 can also be reversed into its first orientation when a storage space within the article of furniture 10 is not required and/or it is desired that clearance beneath the article of furniture 10 be provided for aesthetic reasons or to facilitate cleaning under the article of furniture 10.

It will further be appreciated that numerous modifications can be made to the article of furniture 10 such as, but not limited to, any of the following:

providing a plurality of tubs 24 on the bottom of the frame 12;

providing a lid arrangement in the form of a plurality of independently hinged lids 22 on the frame 12 such that portions of the void 14 can be selectively accessed instead of the entire void 14;

forming compartments in the interior of the void.

It will be appreciated by persons skilled in the art that numerous variations and/or modifications may be made to the illustrated embodiments without departing from their broadly described scope. The present embodiments are, therefore, to be considered in all respects as illustrative and not restrictive.

The invention claimed is:

1. An article of furniture comprising:

a box frame defining a void, a first, operatively upper opening on one side of the frame and a second, operatively lower opening on an opposed, underside of the frame;

a lid arrangement associated with the first opening of the frame for closing the first opening; and a tub member for closing the second opening, the tub member comprising a dished portion and the tub member being reversibly and removably connectable to the box frame so that, in a first orientation, at least the dished portion is received within the void of the box frame to form an assembly of reduced volume for transportation or storage purposes and, in a reversed, second orientation, the dished portion of the tub member extends away from the void to form an assembly of increased volume defined by a combination of the void defined by the frame and the dished portion of the tub member in its second orientation.

2. The article of furniture of claim 1 which includes a set of feet.

3. The article of furniture of claim 2 in which the feet secure the tub member removably to the frame, at least when the tub member is in its second orientation.

4. The article of furniture of claim 3 in which the tub member is attached to the box frame so that a periphery of at least the dished portion of the tub member is recessed with respect to the outer periphery of the box frame, an outwardly extending flange being arranged about a mouth of the tub member.

5. The article of furniture of claim 4 in which a peripheral wall of the dished portion tapers inwardly from the flange to a floor of the tub member.

6. The article of furniture of claim 4 in which each foot includes a connector pin which is received in a corresponding socket defined in an operatively underside of the frame, each connector pin being received through an associated opening defined in the flange of the tub member, each opening, in use, being in register with one of the sockets of the frame.

7. The article of furniture of claim 1 in which the tub member is of a dark color.

8. The article of furniture of claim 1 in which the tub member is of a recyclable material.

9. The article of furniture of claim 1 in which the lid arrangement comprises an upholstered box spring lid.

10. The article of furniture of claim 9 in which the lid is hingedly connected to the frame.

11. The article of furniture of claim 10 which includes at least one fluid operable hinge assembly for hingedly connecting the lid to the frame to assist in opening/closing the lid.

12. The article of furniture of claim 11 in which the fluid operable hinge assembly comprises a pivot-and-slide hinge mechanism and a fluid operable strut hingedly connecting the lid to the frame.

13. An article of furniture comprising:

a box frame defining a void, a first, operatively upper opening on one side of the frame and a second, operatively lower opening on an opposed, underside of the frame, the box frame further having an outer periphery;

a lid arrangement associated with the first opening of the frame for closing the first opening; and a tub member for closing the second opening, the tub member comprising a dished portion and the tub member being attached to the box frame so that a periphery of at least the dished portion of the tub member is recessed with respect to t he outer periphery of the box frame, the dished portion of the tub member extending away from the void so that the void and the dished portion together define a greater volume than the void on its own.

* * * * *